US006001023A

United States Patent [19]

Sanchez et al.

[11] Patent Number: 6,001,023

[45] Date of Patent: Dec. 14, 1999

[54] ANGLE ACTIVATED TRAINING DEVICE FOR GOLFERS

[75] Inventors: Richard D. Sanchez, 18910 SW. 93rd Ave., Miami, Fla. 33157; Gunther H. Steen, 1632 S. Bayshore Ct., Villa No. 1, Miami, Fla. 33133

[73] Assignees: Richard D. Sanchez; Gunther H. Steen, both of Miami, Fla.

[21] Appl. No.: 08/935,431

[22] Filed: Sep. 23, 1997

[51] Int. Cl.[6] ..... A63B 69/36

[52] U.S. Cl. ..... 473/217; 473/224; 473/270

[58] Field of Search ..... 473/224, 217, 473/270, 223

[56] References Cited

U.S. PATENT DOCUMENTS

| | | | |
|---|---|---|---|
| 3,362,023 | 1/1968 | McMahon | 340/279 |
| 3,861,688 | 1/1975 | Butler | 273/183 B |
| 4,106,771 | 8/1978 | Fern | 473/217 |
| 4,667,188 | 5/1987 | Schwartz | 340/689 |
| 4,958,145 | 9/1990 | Morris | 340/689 |
| 5,089,808 | 2/1992 | Amirdash | 340/573 |
| 5,184,826 | 2/1993 | Hall | 473/224 |
| 5,199,712 | 4/1993 | Hoyle et al. | 473/209 |
| 5,221,088 | 6/1993 | McTeigue et al. | 273/187.2 |
| 5,259,620 | 11/1993 | Marocco | 473/224 |
| 5,323,650 | 6/1994 | Fullen et al. | 72/172 |
| 5,330,189 | 7/1994 | Reichow | 473/224 |
| 5,372,365 | 12/1994 | McTeigue et al. | 273/187.2 |
| 5,619,186 | 4/1997 | Schmidt et al. | 340/573 |

*Primary Examiner*—George J. Marlo
*Attorney, Agent, or Firm*—Robert C. Kain, Jr.

[57] ABSTRACT

The angle activated training device, in one embodiment, is worn on the backside of a golfer's rearward shoe. In another embodiment, the training device is mounted onto the shaft of a golf club. The shoe device includes a compact container no larger than the backside of a golfer's shoe. The container is mounted on to the shoe via a clip-on mechanism. The container includes, in its interior, a power source, a control switch, an alarm consisting of either a vibratory alarm or an audible alarm and an angle activated switch. Since these items are electrically coupled together, when the control switch is closed, a vibratory or an audible alarm is issued when the backside of a golfer's shoe is in horizontal position at a final finish position of a golfer's strike. The angle activated training device mounted on the shaft of a golf club includes the same electrical components but the alarm is issued when the club passes through one of at least two horizontal positions when the club is properly swung by a golfer. In another embodiment, the angle activated device on the shaft of a golf club issued alarms when the device passes through each of two predetermined angular positions of the club.

4 Claims, 3 Drawing Sheets

FIG. 8A
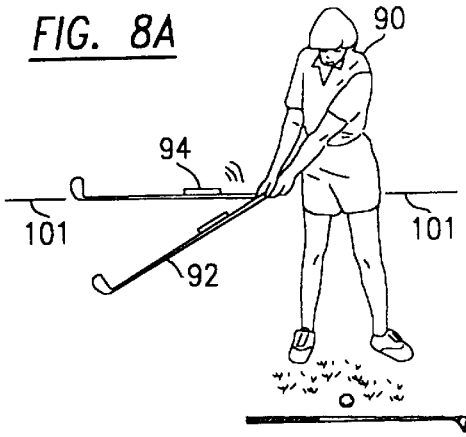
FIG. 8B
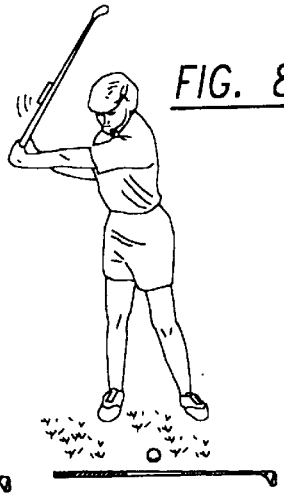
FIG. 8C
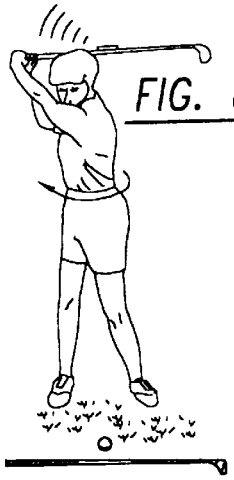
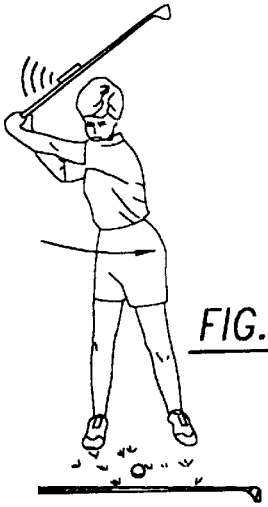
FIG. 8D
FIG. 8E
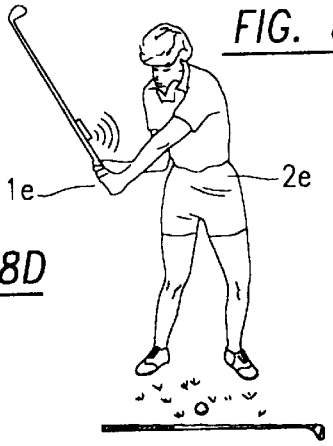
FIG. 8F
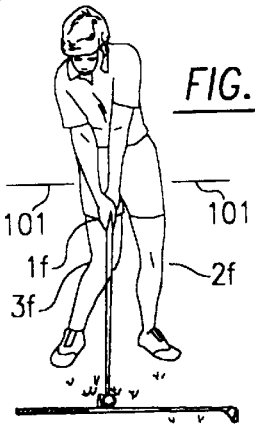
FIG. 8G
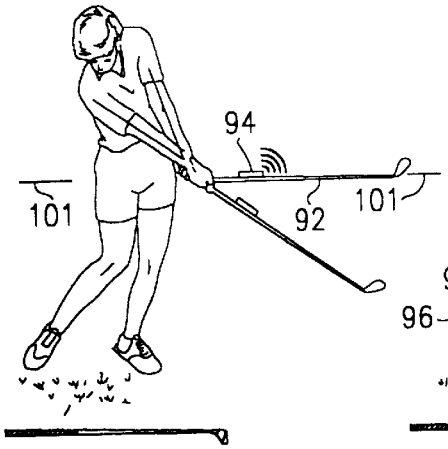
FIG. 8H
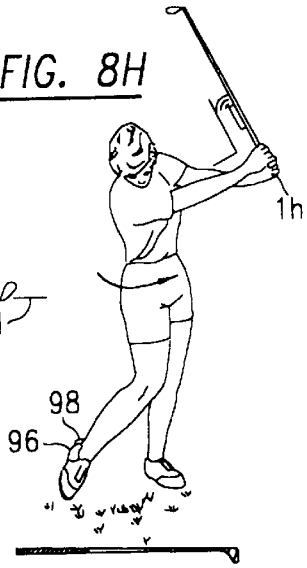
FIG. 8I
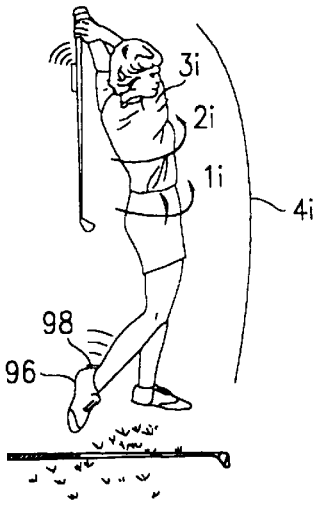

ANGLE ACTIVATED TRAINING DEVICE FOR GOLFERS

The present invention relates to an angle activated training device for golfers.

BACKGROUND OF THE INVENTION

It is well known in the golfing industry that, in order to properly strike and drive a golf ball, the golfer's club must pass through certain angular positions. Further, it is also known that the rearward shoe of the golfer, opposite the forward or target shoe, must be raised at the end of a full golf swing such that the backside of the shoe is generally horizontal with respect to a vertical plane extending through the body of the golfer and perpendicular to the ground plane.

U.S. Pat. No. 3,362,023 to McMahon discloses a device which sounds an audible alarm when a certain angle is exceeded. The device uses a pair of mercury switches to detect an angular change of position. The unit, having the pair of mercury switches, is worn on the hat of a golfer. A second angle detection unit, with another mercury switch, is clipped onto the golfer's shoulder. The shoulder unit resets the hat buzzer unit.

U.S. Pat. No. 4,667,188 to Schwartz discloses a portable alarm activated by detecting an angular displacement of the alarm unit.

U.S. Pat. Nos. 5,221,088 to McTeigue and 5,372,365 to McTeigue disclose an angle detector mounted on the spine of a golfer. See FIG. 5. The angle detector is an inclinometer and preferably an accelerometer which generally continuously measures the angular displacement of the golfer's spine relative to the vertical plane. The detector is strapped to the back of the golfer.

The following patents are of general interest: U.S. Pat. No. 5,619,187 to Schmidt discloses a foot weight alarm which measures excessive weight on a foot. Excessive force generates an alarm signal. The unit has a flat pad sensor disposed beneath the foot of the user in the user's shoe. U.S. Pat. No. 5,323,650 to Fullen discloses a system for continuously measuring forces applied to the foot. A flat pad sensor, beneath the user's foot, is utilized to generate signals.

U.S. Pat. No. 4,958,145 to Morris discloses a back incline indicator. The indicator is strapped onto the user's back. U.S. Pat. No. 5,089,808 to Amirdash discloses a device giving a vibratory warning when undesired lifting position is assumed. This unit is mounted in the user's shirt pocket. An angle detection device is included in the alarm circuit.

U.S. Pat. No. 3,861,688 to Butler discloses a golf training device which includes a string or cord connected between a unit, worn on the golfer's wrist, and a club attachment.

OBJECTS OF THE INVENTION

It is an object of the present invention to provide an angle activated training device for golfers.

It is another object of the present invention to provide an angle activated training device which easily clips on or mounts onto a golf club.

It is a further object of the present invention to provide an angle activated training device which clips on to the backside of a golfer's rearward shoe.

It is an additional object of the present invention to generate a vibratory signal or an audible signal when the golf club or the golfer's rearward shoe passes through a horizontal plane.

It is an additional object of the present invention to provide an angle activated training device which is worn on the backside of a golfer's rearward shoe which issues a vibratory signal when the backside of the golfer's shoe is horizontal at the finish position of a golfer's stroke.

It is another object of the present invention to provide an angle activated training device for golfers which can be clipped on to a golf club wherein the training device issues a vibratory signal when the club passes through one of at least two predetermined angular positions.

SUMMARY OF THE INVENTION

The angle activated training device, in one embodiment, is worn on the backside of a golfer's rearward shoe. In another embodiment, the training device is mounted onto the shaft of a golf club. The shoe device includes a compact container no larger than the backside of a golfer's shoe. The container is mounted on to the shoe via a clip-on mechanism. The container includes, in its interior, a power source, a control switch, an alarm consisting of either a vibratory alarm or an audible alarm and an angle activated switch. Since these items are electrically coupled together, when the control switch is closed, a vibratory or an audible alarm is issued when the backside of a golfer's shoe is in horizontal position at a final finish position of a golfer's strike. The angle activated training device mounted on the shaft of a golf club includes the same electrical components but the alarm is issued when the club passes through one of at least two horizontal positions when the club is properly swung by a golfer. In another embodiment, the angle activated device on the shaft of a golf club issued alarms when the device passes through each of two predetermined angular positions of the club.

BRIEF DESCRIPTION OF THE DRAWINGS

Further objects and advantages of the present invention are found in the detailed description of the preferred embodiments when taken in conjunction with the accompanying drawings in which:

FIG. 8A through 8I diagrammatically illustrate various positions of a golf club, a golfer and the golfer's shoe during a full golf swing;

DETAILED DESCRIPTION OF THE PREFERRED EMBODIMENTS

The present invention relates to an angle activated training device for golfers.

Figure 1:
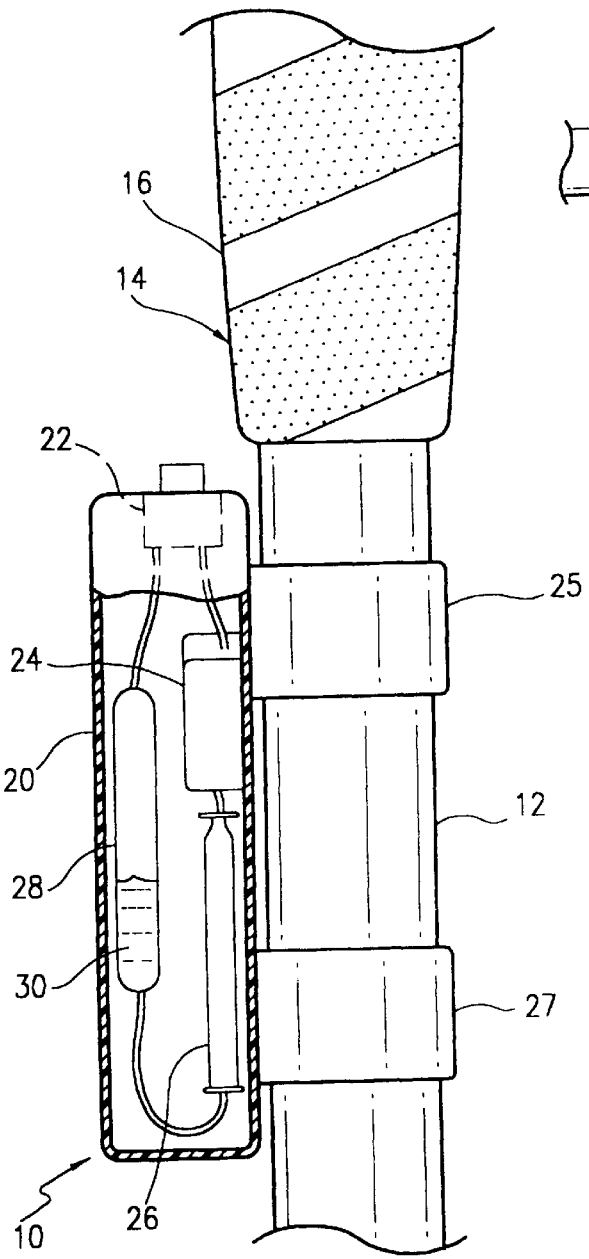
FIG. 1 diagrammatically illustrates a portion of a golf club with the angle activated training device removably attached to the golf club shaft and illustrated as a partial, broken-away view, in accordance with the principles of the present invention.

FIG. 1 diagrammatically illustrates angle activated device 10 removably attached to shaft 12 of golf club 14. Handle 16 enables the golfer to grip shaft 12 of the golf club. See, for example, FIGS. 8A through 81. Device 10 may be mounted on grip 16.

Figure 2:
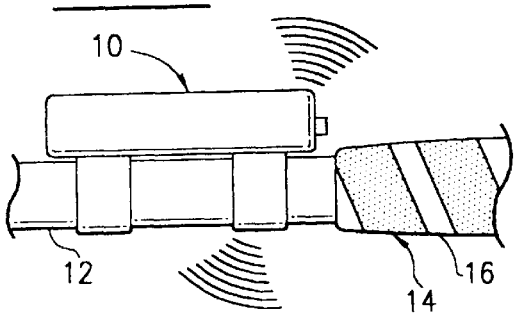
FIG. 2 diagrammatically illustrates one angular position wherein the training device issues an alarm in accordance with the principles of the present invention.

Angle activated training device 10 includes a container 20 having, in its interior, a control or ON/OFF switch 22, an alarm unit 24, a power source such as a battery 26 and an angle activated switch 28. In a preferred embodiment, angle activated switch 28 is a mercury switch. Mercury 30 is diagrammatically illustrated in FIG. 1. Shaft 12 is illustrated in a vertical position in FIG. 1. In the vertical position, mercury switch 28 is in an OFF switch state. In FIG. 2, golf club 14 is in a horizontal position and training device 10 is issuing an alarm to the golfer. Switch 28 has closed the electrical circuit and is in an ON switch state.

Alarm unit 24 may be a vibratory motor, a vibratory electrical integrated circuit or may be an audible buzzer or audible electronic circuit. The preferred embodiment, a vibratory motor or a vibration circuit is utilized. This enables the golfer to train without disturbing other golfers in the area. The vibrations emanating from vibratory circuit 24 pass through coupler system 24, 26 and affect shaft 12 and handle 16 such that the golfer has positive reinforcement that he or she has placed the club in the appropriate position during a golf swing.

Angle activated training device 10 may be attached to shaft 12 by several attachment mechanisms. The Attachment Table which follows provide some examples:

Attachment Table

Clips

Tie Straps

Straps with snaps

Straps with hook and loop fasteners (VELCRO)

Figure 3:
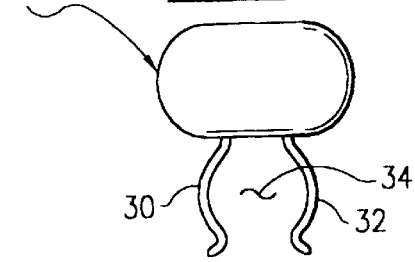
FIG. 3 diagrammatically illustrates an end view of the angle activated training device and specifically diagrammatically illustrates one mechanism to attach the training device container to the shaft of a golf club.

FIG. 3 diagrammatically illustrates training device 10 having S-shaped clips 30, 32. The golf club shaft is placed in space 34 defined by clips 30, 32. In this manner, the training device 10 can be easily clipped on or removed from the shaft of the golf club.

Figure 4:
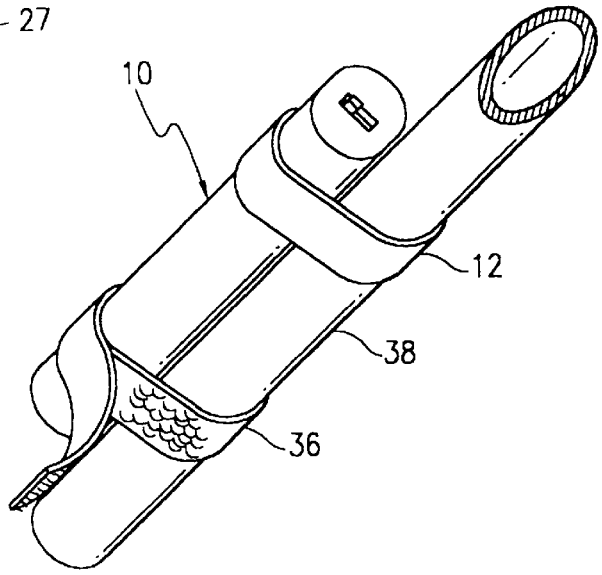
FIG. 4 diagrammatically illustrates a portion of the shaft of the golf club and another mechanism to removably attach the training device to the golf club shaft or grip region.

FIG. 4 diagrammatically illustrates shaft 12 and angle activated training device 10 attached to the shaft or grip. Training device 10 is attached to the shaft by a pair of straps 36, 38. Strap 36 utilizes hook and loop fasteners commonly sold under the trademark VELCRO. In this manner, training device 10 is quickly attached to the shaft of the golf club and, with minimal effort, can be quickly removed from the shaft. Also, the tie mechanism shown in FIG. 4 can accommodate shafts having different diameters.

The training device may be attached to the grip portion of the golf club in order to reduce the possibility of longitudinal movement along the club shaft. The claims appended hereto are meant to include this attachment position.

Figure 6:
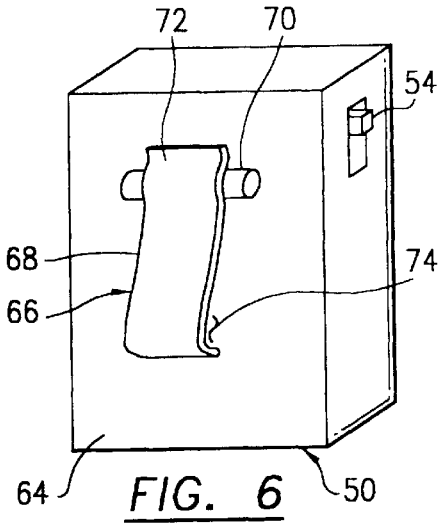
FIG. 6 diagrammatically illustrates the backside of the angle activated training device for the golfer's shoe and particularly the clip-on mechanism.
Figure 5:
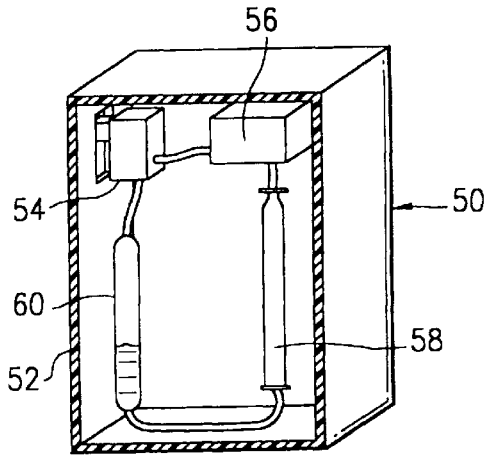
FIG. 5 diagrammatically illustrates the angle activated training device adapted to be worn on the backside of a golfer's rearward shoe, with the container shown in a partial, broken-away view.

FIG. 5 diagrammatically illustrates an angle activated training device 50 having certain electrical components mounted within container 52. Training device 50 includes control switch 54, alarm device 56, a power source such as a battery 58 and an angle activated switch 60. In a preferred embodiment, angle activated switch 60 is a mercury switch. In FIG. 5, training device 50 is in a vertical position wherein mercury switch 60 is in an OFF state. FIG. 6 diagrammatically shows training device 50 having a backside 64 and a clip-on mechanism 66. Clip-on mechanism 66 includes a clip body 68, a pivot point 70 and a lever surface 72. Clip mechanism 66 also includes a spring (not shown) such that when the user depresses lever surface 72, clip body 68 rises and lifts from backside surface 64 of the container such that the backside of a golfer's shoe can be placed in space 74 between the backside surface of clip body 68 and backside surface 64 of training device 50. Control switch 54 is also illustrated in FIG. 6. The user can turn ON and OFF the angle activated training device 50, 10 by changing the position of the control switch.

Figure 7:
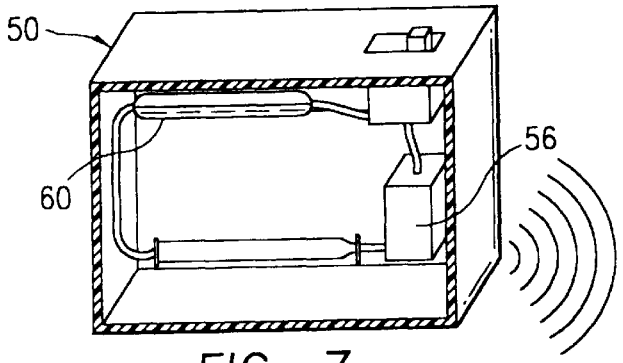
FIG. 7 diagrammatically illustrates the angle activated training device for the golfer's shoe in a horizontal position, issuing an alarm signal.

FIG. 7 diagrammatically illustrates training device 50 in a horizontal state. In this horizontal state, mercury switch 60 is in an ON state and alarm mechanism 56 is generating an alarm signal. In the preferred embodiment, this alarm signal is a vibration signal such that the other golfers are not disturbed.

FIGS. 8A through 8I diagrammatically illustrates various positions of a golfer doing a full golf swing. The following tables summarize the actions of the golfer.

FIG. 8A: Take Away
1. Arms, hands, club start as unit

FIG. 8B: Half Swing—Pre-Stroke
1. Weight shifts to rear (target (forward) knee turns toward rear knee)
2. Wrists cock at hip level
3. Target (forward) heel may come off grass FIG. 8C: Top of Swing
1. Hips turn to rear
2. Back to target
3. Club parallel to ground, full backswing length
4. Hands over rear shoulder FIG. 8D: Half Swing—Stroke (forward)
1. Weight shifts to target (forward) side
2. Arms, hands, and club start down as unit FIG. 8E: Preimpact
1. Wrists 1*e* uncock at hip level
2. Hips 2*e* return to square
3. Target (forward)_heel down FIG. 8F: Impact
1. Arms, hand 1*f* and club extended at contact
2. Target knee 2*f* toward target
3. Rear knee 3*f* toward target knee FIG. 8G: Postimpact
1. Wrists recock at target hip level
2. Hips turned to target as swing continues smoothly FIG. 8H: Half Swing—Post Impact Stroke
1. Weight on target side (rear knee nearly touches target knee)
2. Rear forearm perpendicular to club and wrist 1 h FIG. 8I: Finish
1. Hips 1*i* face target
2. Chest 2*i* to target
3. Rear shoulder 3*i* closer to target than target shoulder
4. Balanced ending 4*i*; hold position at end to check for balance FIG. 8A shows a golfer 90 holding golf club 92. An angle activated training device 94 is attached to the golf club 92.

In one embodiment, angle activated training device 94 issues an alarm when the club is in a horizontal position in plane 101. Training device 94 continues to issue the alarm when the club is in the positions shown in FIGS. 8B through 8E until the club passes through horizontal plane 101 shown in FIG. 8F. In FIG. 8G, training device 94 begins issuing an alarm when club 92 passes through horizontal position in plane 101. Beneath plane 101, training device 94 does not issue the alarm. In FIGS. 8H and 81, training device 94 continues to issue the alarm.

Alternatively, the vibratory alarm may be issued for a predetermined period of time after the club passes through the predetermined angular position. A timing circuit or delay circuit may be added to the output of the angle detector. This system would notify the golfer that he or she has properly raised the club. See FIGS. 8C and 8I.

In FIGS. 8H and 8I, the golfer's rearward shoe 96 has a training device 98 mounted thereto. In FIG. 8I, training device 98 issues an alarm indicating that the backside of the golfer's shoe is in a horizontal position.

Figure 9A:
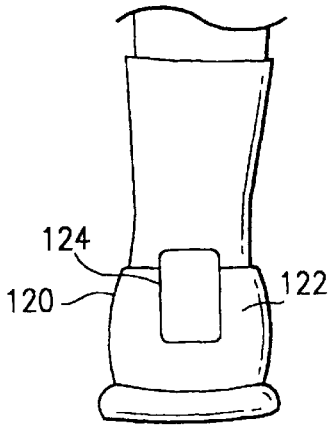
FIG. 9A through 9C diagrammatically illustrate the positions of the backside of a golfer's shoe during a full golf swing.
Figure 9B:
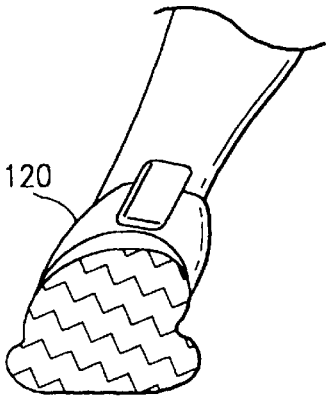

FIGS. 9A, B and C diagrammatically illustrate this feature. In FIG. 9A, golfer's shoe 120 includes a backside 122. Training device 124 is clipped on to the backside 122 of the golfer's shoe. As shown in FIGS. 8A through 8F, during a substantial portion of the golfer's swing, the golfer's rearward shoe remains substantially flat on the ground. In this position, the training device is in an OFF state. In FIG. 9B, golfer's shoe 120 is being partially lifted off the ground, this is generally similar to the position shown in FIGS. 8G and 8H.

Figure 9C:
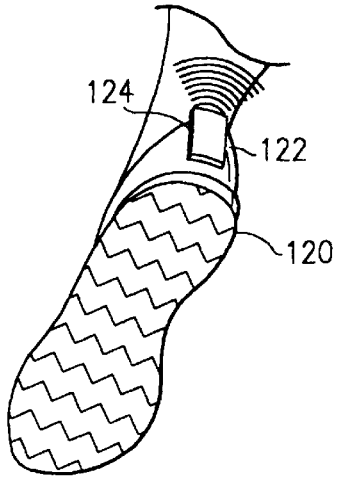

In FIG. 9C, shoe 120 is substantially lifted and backside 122 is generally horizontal. This is best shown in FIG. 8I. In the horizontal position, training device 124 issues an alarm.

In order to enhance the operation of the present invention, the angle activated training device can be modified such that the golf club device can be activated by at least one of two predetermined angles. For example, it is well known that some golfers do not fully raise the club behind their head as shown in FIG. 8C. In order to ensure that the golfers fully raise the club, the unit could be turned OFF when the unit reaches position shown in FIG. 8C. In this situation, the electrical circuit shown in FIG. 10 may be utilized.

Figure 10:
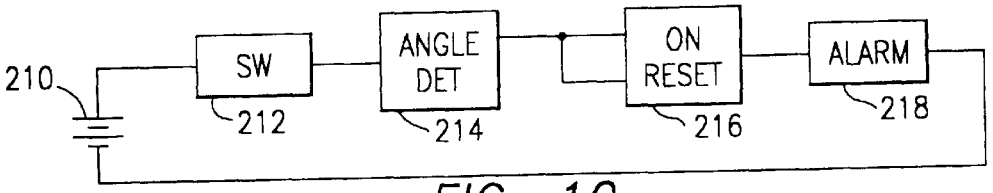
FIG. 10 diagrammatically illustrates an electrical system that maintains the ON alarm state until the angle activated device passes through a second or multiple predetermined angular position.

In FIG. 10, a power source 210 is electrically connected to a control switch 212 and angle detector 214, a toggle ON, toggle OFF switch 216 and an alarm unit 218. Unit 216 may be a time delay circuit. The alarm unit may be an audible alarm or a vibratory alarm. When the club passes through a first predetermined angle, the angle detector changes the state of its output and the leading edge, if the system is programmed in this manner, activates the alarm ON circuit. This alarm ON circuit may be a monostable multivibrator (MMV), may be a mechanical device which toggles ON and toggles OFF or may be a leading edge detector circuit. In other words, when the electrical output from angle detector 214 goes high, switch sensor 216 detects the higher electrical state of the output of angle detector 214. The switch system 216 then issues a high electrical signal on its output and alarm unit 218 generates an alarm signal directed to the golfer. That alarm system remains ON until the angle detector 214 generates another ON state on its output. This second ON state at the output of angle detector 214 resets the switch sensor 216 and turns OFF that switch's output. The alarm 218 then is turned OFF. This could be accomplished by turning OFF the vibratory unit in the club position shown in FIG. 8C. The system then remains OFF through the golf club position shown in FIGS. 8D through 8H. When the club is horizontal at the end of the swing just prior to the position shown in FIG. 8A, the training device would go ON. As such, electronic toggle system 216 can be programmed to the following sequence, at the first horizontal position ON, at the next horizontal position OFF, at the next horizontal position OFF (FIG. 8F) at the next horizontal position OFF (FIG. 8G), at the next horizontal position ON prior to ending position in FIG. 81. The following Alarm ON System Table provides some examples.

Alarm ON System

MMV (monostable multivibrator)

Mechanical (toggle ON, toggle OFF)

Leading edge detector circuit

The claims appended hereto are meant to cover modifications and changes within the spirit and scope of the present invention. For example, other types of angle detection switches may be utilized such as inclinometers or accelerometers.

What is claimed is:

1. An angle activated training device for golfers to be worn on a backside of a golfer's rearward shoe comprising:

a compact container no larger than said backside of said golfer's shoe;

a clip-on mechanism, attached to said container, said clip-on mechanism adapted to removably affix said container to said backside of said golfer's rearward shoe; and, a power source, a control switch, an alarm consisting of one of a vibratory alarm and an audible alarm, and an angle activated switch, all electrically coupled together and mounted in said container and forming means for generating an alarm directed to said golfer indicating a horizontal position of said backside of said golfer's rearward shoe at a finish position of a golfer's stroke.

2. An angle activated training device for golfers as claimed in claim 1 wherein said means for generating said alarm includes said vibratory alarm such that the alarm directed to said golfer is silent.

3. An angle activated training device for golfers as claimed in claim 2 wherein said angle activated switch is a mercury switch, said mercury switch being open when said container is in a vertical position while disposed on the backside of said golfer's rearward shoe, said mercury switch being closed when said container is horizontally disposed and said backside of said golfer's rearward shoe is in said horizontal position at said finish position of said golfer's stroke.

4. An angle activated training device for golfers as claimed in claim 1 wherein said angle activated switch is a mercury switch, said mercury switch being open when said container is in a vertical position while disposed on the backside of said golfer's rearward shoe, said mercury switch being closed when said container is horizontally disposed and said backside of said golfer's rearward shoe is in said horizontal position at said finish position of said golfer's stroke.

* * * * *